US011590060B2

(12) United States Patent
Rodriguez et al.

(10) Patent No.: US 11,590,060 B2
(45) Date of Patent: Feb. 28, 2023

(54) EMESIS CONTAINMENT SYSTEM

(71) Applicants: Isaac Rodriguez, Anaheim, CA (US); Adam Rodriguez, Murrieta, CA (US)

(72) Inventors: Isaac Rodriguez, Anaheim, CA (US); Adam Rodriguez, Murrieta, CA (US)

( * ) Notice: Subject to any disclaimer, the term of this patent is extended or adjusted under 35 U.S.C. 154(b) by 432 days.

(21) Appl. No.: 16/794,213

(22) Filed: Feb. 18, 2020

(65) Prior Publication Data

US 2020/0261320 A1 Aug. 20, 2020

Related U.S. Application Data

(60) Provisional application No. 62/806,894, filed on Feb. 17, 2019.

(51) Int. Cl.
*A61J 19/00* (2006.01)
*B65D 33/14* (2006.01)

(52) U.S. Cl.
CPC ..... *A61J 19/00* (2013.01); *B65D 33/14* (2013.01)

(58) Field of Classification Search
CPC ..... A61J 19/00; A61J 19/02
USPC ..... 4/274
See application file for complete search history.

(56) References Cited

U.S. PATENT DOCUMENTS

| | | | | |
|---|---|---|---|---|
| 3,067,744 | A * | 12/1962 | Barishman | A61J 19/00 4/258 |
| 3,920,179 | A * | 11/1975 | Hall | A61J 19/00 4/144.2 |
| 4,610,039 | A * | 9/1986 | Stern | A61J 19/00 141/390 |
| 5,112,322 | A | 5/1992 | Hathaway | |
| 5,971,969 | A | 10/1999 | Cashel | |
| 6,554,810 | B1 * | 4/2003 | Wilk | A61J 19/00 604/323 |
| 6,589,220 | B2 | 7/2003 | Taylor | |
| 6,874,936 | B2 | 4/2005 | Gillis et al. | |
| 7,947,024 | B2 | 5/2011 | Ramage et al. | |
| 2005/0070864 | A1 | 3/2005 | Fellion | |

OTHER PUBLICATIONS

Vomex emesis bag—vomex.net.
"Barf Bib"—by The Barf Bib Company—quadmed.com/product/the-barf-bib.

* cited by examiner

*Primary Examiner* — Huyen D Le
(74) *Attorney, Agent, or Firm* — KOS IP Law LLP

(57) ABSTRACT

An emesis containment system is configured to attach to the face of a wearer in order to contain emesis ejected from the wearer's mouth and/or nose without necessitating the wearer, or any other party, to use their hands to hold, guide, or otherwise interact with the system during use. The emesis containment system comprises a rigid or semi-rigid mask configured to attach to the user's face and a flexible bag attached to the mask. The system including the mask and flexible bag move with the wearer's head, and emesis ejected from the wearer's mouth and/or nose is directed into the flexible bag.

17 Claims, 15 Drawing Sheets

EMESIS CONTAINMENT SYSTEM

CROSS-REFERENCE TO RELATED APPLICATIONS

The application claims priority from U.S. Provisional Application No. 62/806,894, which was filed Feb. 17, 2019, the entirety of which is hereby incorporated by reference.

BACKGROUND

The present disclosure relates to containment of orally discharged substances.

Healthcare providers, and particularly first responders such as emergency medical services (EMS) personnel often are called upon to treat and transport patients prone to orally discharge substances such as emesis (i.e., vomit) and sputum (collectively referred to herein as emesis). Thus, EMS personnel often keep a supply of bags on hand to receive and contain such emesis.

FIG. 1 shows a typical emesis bag comprises a tubular plastic bag having an open top end and a closed bottom end. The top end of the bag can be attached to a rigid or semi-rigid ring. The illustrated ring has a tapered ring body defining a partial funnel shape from a top flange/upstream edge to a downstream edge. As shown, the bag may be drawn through the ring so that the top of the bag is folded over the top flange and a top edge of the bag is adhered to an outer surface of the ring.

To use a typical emesis bag, the patient, EMS personnel or a third-party holds the bag aligned with the mouth of a vomiting or spitting patient. Sometimes patients are non-responsive, or so lacking in consciousness or self-control as to be unable to hold and/or control an emesis bag. Third parties may prove unreliable in holding the bag, and using EMS personel to hold the bag strains their ability to provide treatment. As such, when a patient spits or vomits uncontrollably, there may be little or no containment of the emesis, fouling medical equipment and, possibly, personnel.

SUMMARY

The present specification describes embodiments of an emesis containment system that may be installed upon a patient in order to contain any emesis such patient may emit during treatment and/or transport without requiring any affirmative guidance on the part of the patient. Embodiments can also be used in non-medical instances in which there is a risk of vomiting.

In accordance with one embodiment, the present specification provides an emesis containment system. The system comprises a rigid or semirigid contoured mask having an upstream opening defined by an upstream edge, a downstream opening defined by a downstream edge, and an elongated body extending from the upstream edge to the downstream edge. A contact portion of the upstream edge is configured to contact a wearer's face when the mask is in place, the contact portion having a bottom-most point of the upstream edge configured to be below the wearer's chin when the wearer's head is in a reference position in which the wearer's line of sight is horizontal. A vent portion of the upstream edge is configured to be spaced from the wearer's face when the mask is in place, the vent portion having an apex of the upstream edge configured to be even with or higher than a tip of the wearer's nose when the wearer is in the reference position. Left and right transitions are disposed along the upstream edge between the vent portion and the contact portion. A securement structure is configured to hold the mask in place so that the mask moves with the wearer's head. A flexible bag is attached to the mask and extends therefrom so that the downstream opening of the mask communicates with the bag.

In some embodiments, a bottom-most point of the downstream edge is lower than the bottom-most point of the upstream edge and an apex of the downstream edge is lower than the apex of the upstream edge when the wearer is in the reference position.

In some such embodiments, an axis of the downstream opening is inclined downwardly from horizontal when the wearer is in the reference position.

In further embodiments the body of the mask is inclined downwardly from the bottom-most point of the upstream edge to the bottom-most point of the downstream edge when the wearer is in the reference position.

In additional embodiments the apex of the downstream edge is disposed higher than the wearer's mouth when the wearer is in the reference position.

In some such embodiments the apex of the upstream edge is disposed forwardly of the tip of the wearer's nose when the wearer is in the reference position.

In additional embodiments the apex of the downstream edge is disposed higher than a portion of the bridge of the wearer's nose when the wearer is in the reference position.

In yet additional embodiments the downstream opening has a major axis extending from the bottom-most portion of the downstream edge to the apex of the downstream edge, and has a minor axis normal to the major axis, and wherein the major axis is greater than the minor axis.

In another embodiment, no portion of the mask is disposed directly in front of a mouth of the wearer when the wearer is in the reference position.

In yet another embodiment, when the wearer is in the reference position the transitions are vertically even with or higher than a tip of the wearer's nose and the apex of the upstream edge is vertically higher than the transitions.

Some such embodiments additionally comprise an air-permeable textile layer extending proximally from the upstream edge in the vent portion.

In yet additional embodiments, the transitions are adjacent the wearer's cheeks when the wearer is in the reference position.

In some such embodiments the apex of the upstream edge is vertically higher than the transitions when the wearer is in the reference position.

In still further embodiments the flexible bag is releasably attachable to the mask.

In such embodiments, the flexible bag may comprise a rigid or semirigid ring at or adjacent an open end of the flexible bag and the mask comprises an attachment structure configured so that the ring can be releasably attached to the attachment structure.

In still additional embodiments, the mask additionally comprises a connector configured to releasably attach to a source of gas so that a flow of gas can be delivered into a mask space between the wearer's face and the body of the mask.

In still further embodiments, the flexible bag is configured so that when a mass of matter is within the flexible bag, the flexible bag will readily bend about the downstream edge of the mask so that the bottom end of the bag is drawn downwardly by gravity regardless of the position of the wearer's head.

In accordance with another embodiment, the present specification provides a method of using a hands-free emesis containment system, comprising installing a mask or interface on the face of a wearer so that the mask or interface moves with the wearer, and the mask is aligned with the opening of a flexible bag that is configured to flex and bend relative to the mask when a portion of emesis is within the flexible bag so that the flexible bag hangs from the mask regardless of the disposition of the wearer's head.

In some embodiments, a textile liner is arranged to block emesis from flowing in one or more gaps between a face of the wearer and the mask or interface.

DESCRIPTION

Figure 1:
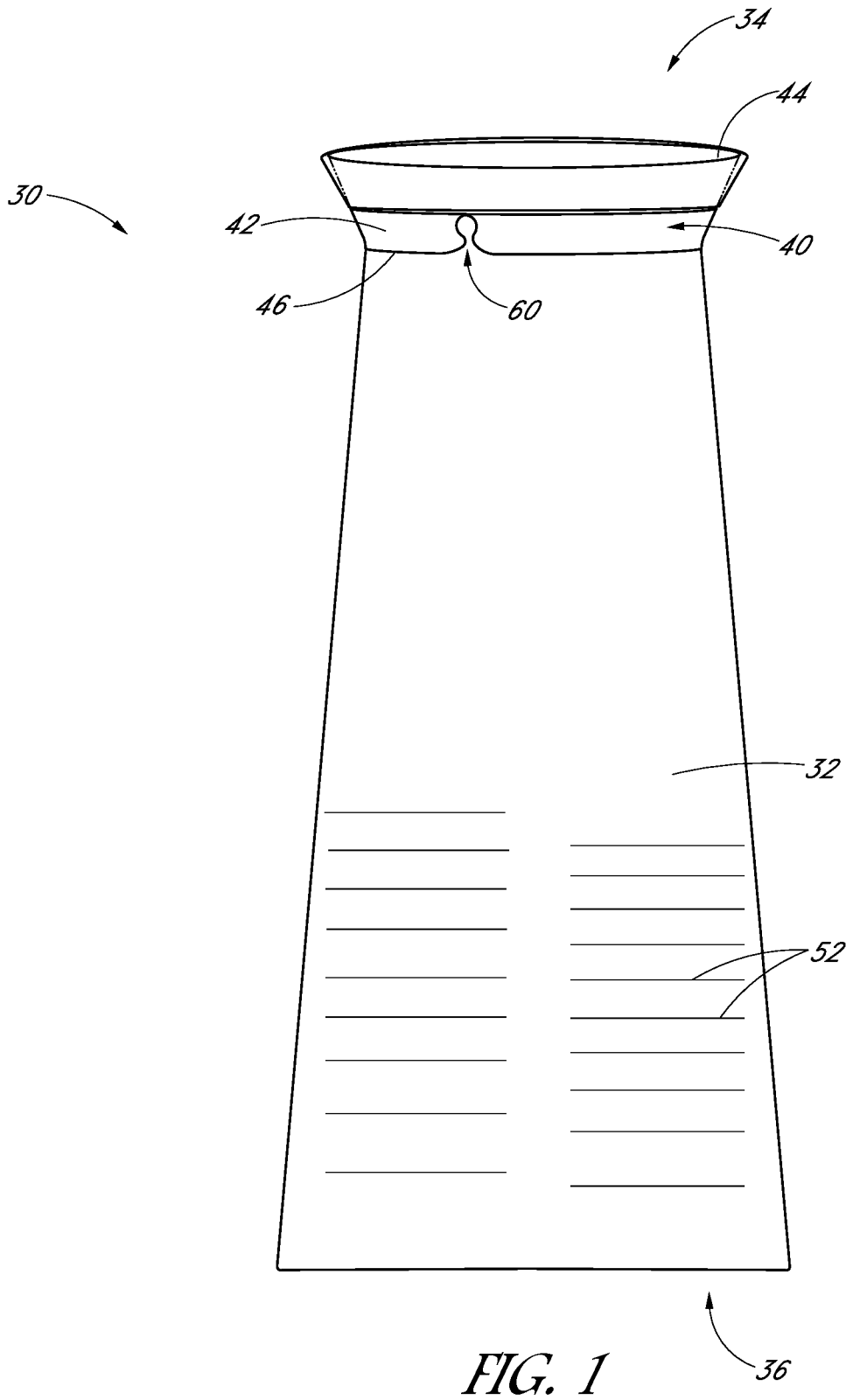
FIG. 1 is a front view of a typical emesis bag.

With initial reference to FIG. 1, a typical emesis bag 30 comprises a tubular flexible plastic bag body 32 having an open top end 34 and a closed bottom end 36. The top end 34 of the bag 32 can be attached to a rigid or semi-rigid ring 40. The illustrated ring 40 has a tapered ring body 42 that is partially funnel-shaped from an upstream edge 44 to a downstream edge 46. As shown, the bag 32 may be drawn through the ring 40 so that the top of the bag is folded over a top flange and a top edge of the bag is adhered to an outer surface of the ring 40. In some embodiments, a receiver slot 50 is provided so that once emesis has been deposited into the bag 30, the bag can be twisted to close off the emesis-containing portion, and the twisted portion inserted into the receiver slot 50 to perfect containment of the emesis. Indicia 52 may be provided to measure the volume of emesis collected.

Figure 2:
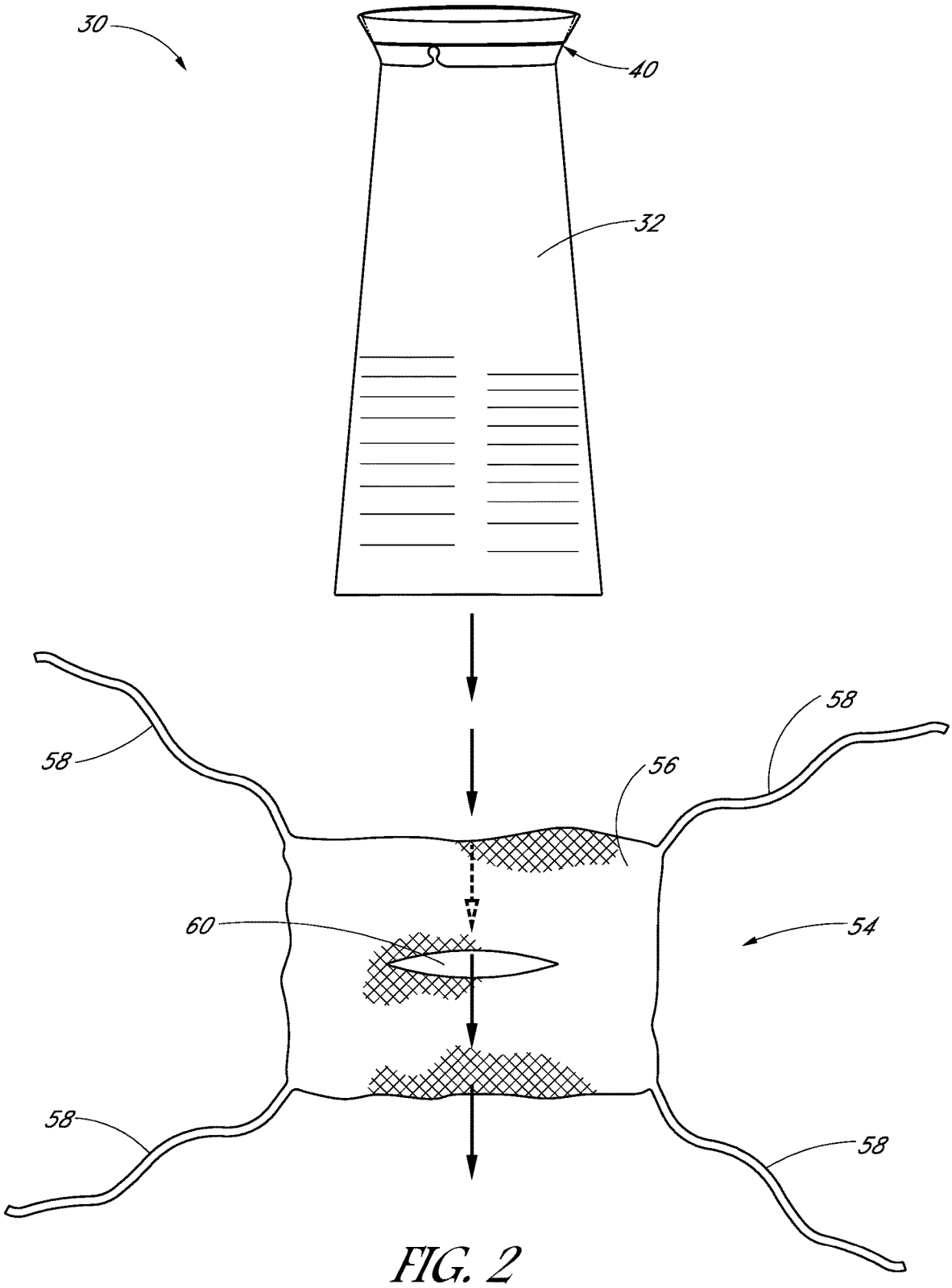
FIG. 2 is a front view of one embodiment of an emesis containment system during assembly.
Figure 3:
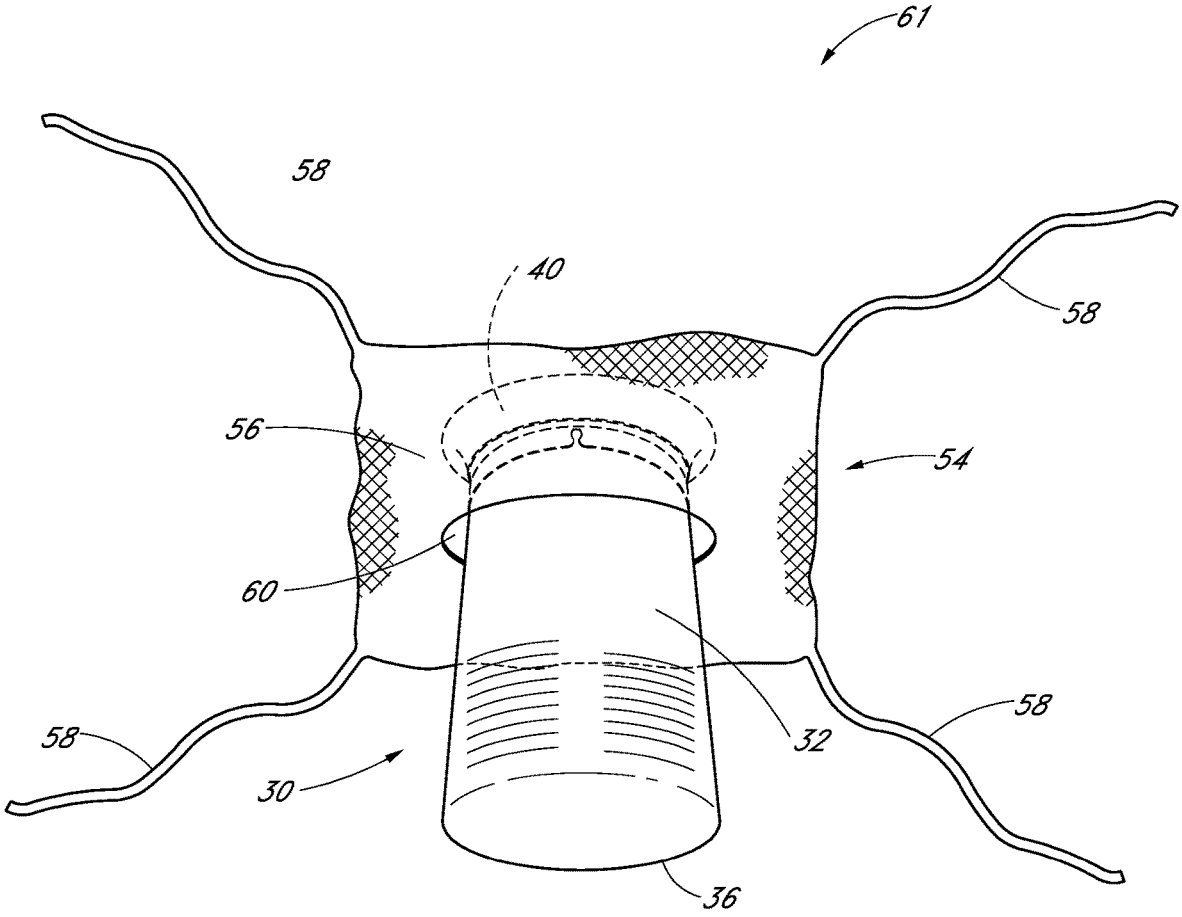
FIG. 3 shows the assembly of FIG. 2 fully assembled.
Figure 5:
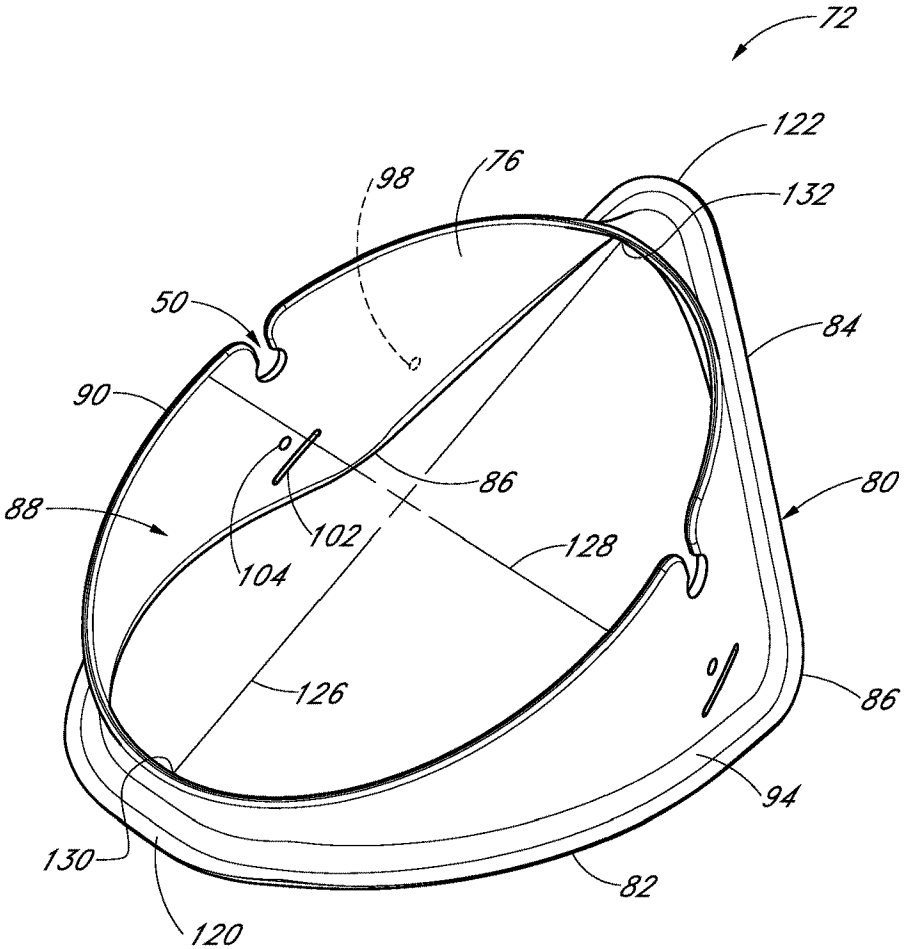
FIG. 5 is another perspective view of the mask of FIG. 4.
Figure 4:
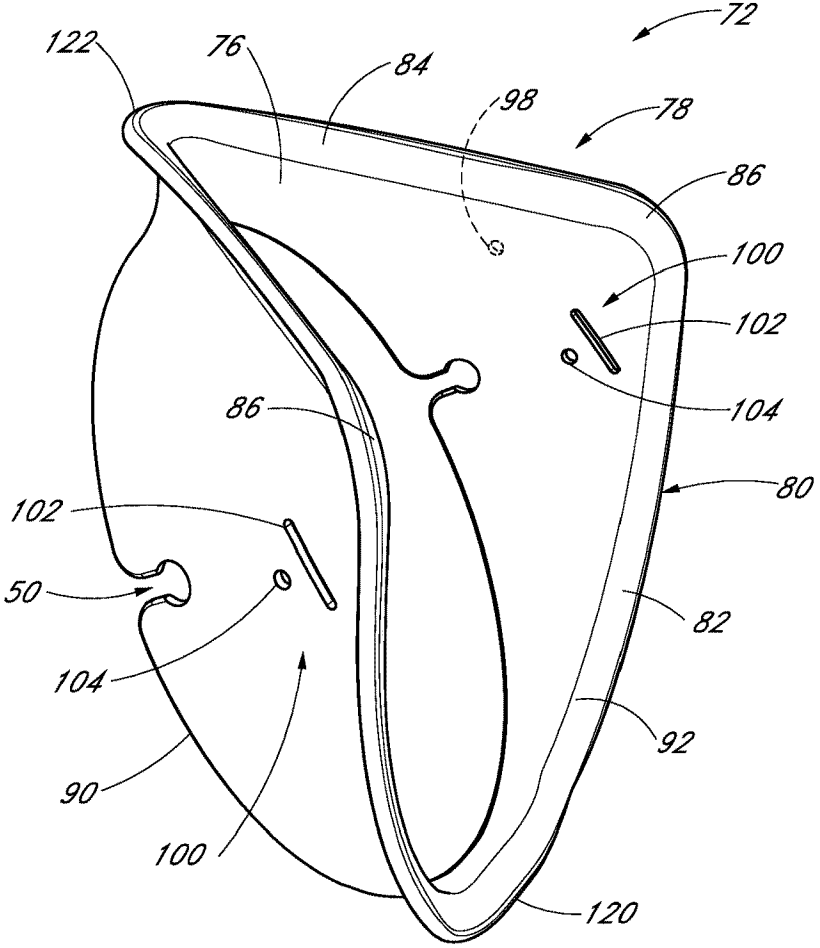
FIG. 4 is a perspective view of an embodiment of a mask for use in an embodiment of an emesis containment system.

With additional reference to FIGS. 2 and 3, a typical surgical mask 54 comprises a flexible mask body 56 and a plurality of straps 58 configured to extend behind a wearer's head so as to hold the mask body 56 over the face of the wearer. In the illustrated embodiment, an aperture 60 can be formed in the mask body 56 by, for example, ripping or cutting the textile making up the mask body 56. Preferably, the aperture 60 is sized and configured so that the ring 40 of the emesis bag 30 cannot fit through the aperture 60. However the flexible bag portion 32 of the emesis bag 30 is easily deformed and pushed through the aperture 60. In a preferred embodiment, an emesis containment system 61 is formed by starting with an emesis bag 30 positioned on an inner side of the mask body 56 and pushing the plastic bag portion 32 through the aperture 60 so that the flexible bag portion 32 extends from an outer side of the mask body 56, but the ring 40 is retained against the inner surface of the mask body 56 and supported thereby so that the mask body 56 and emesis bag 30 move together as one.

In a preferred embodiment, the present emesis containment system 61 can be placed on the wearer by placing the mask 52 on the wearer's face with the ring 40 and open end of the bag in contact with the wearer's face and aligned with the wearer's mouth. The straps 58 are used to retain the mask body 56 in place. Although the ring 40 does not create a contiguous seal with the user's face, the mask body 56 surrounds the ring 40 and the wearer's mouth and nose. As such, emesis ejected by the wearer will mostly be directed through the ring 40 and into the flexible bag 32. As the illustrated ring 40 does not conform to the user's face, there will likely be gaps between the ring 40 and the wearer's face and nostrils. It is anticipated that some portion of emesis may make its way through such gaps between the ring 40 and the user's face. The mask body 56 preferably covers such gaps, and thus provides resistance to free flow of such emesis.

With reference next to FIGS. 4-8, another embodiment of an emesis containment system 70 comprises a rigid or semirigid contoured mask 72 configured to be placed upon a wearer's face. A flexible bag 74 can be attached to the mask 72.

In the illustrated embodiment, the contoured mask 72 comprises a mask body 76 having an upstream, or proximal, opening 78 defined by an upstream, or proximal, edge 80 and a downstream, or distal or outlet, opening 88 defined by a downstream, or distal, edge 90. The upstream edge 80 comprises a contact portion 82 configured to sealingly engage a wearer's face, and a vent portion 84 configured to be spaced from the wearer's face. The vent portion 84 and contact portion 82 meet at a pair of transitions 86 defined on opposing left and right sides of the mask 72. Preferably, the mask body 76 is configured to be secured on the wearer's face so that the mask body 76 is in contiguous sealing contact with the wearer's face on the cheeks and about the chin, and most preferably extends over but is spaced from the nose of the wearer.

The illustrated mask 72 flares radially outwardly at and adjacent the upstream edge 80, defining an inner flange 92 contiguous with an inner surface of the mask body 76, and defining an outer flange 94 contiguous with an outer surface of the mask body 76.

Figure 7:
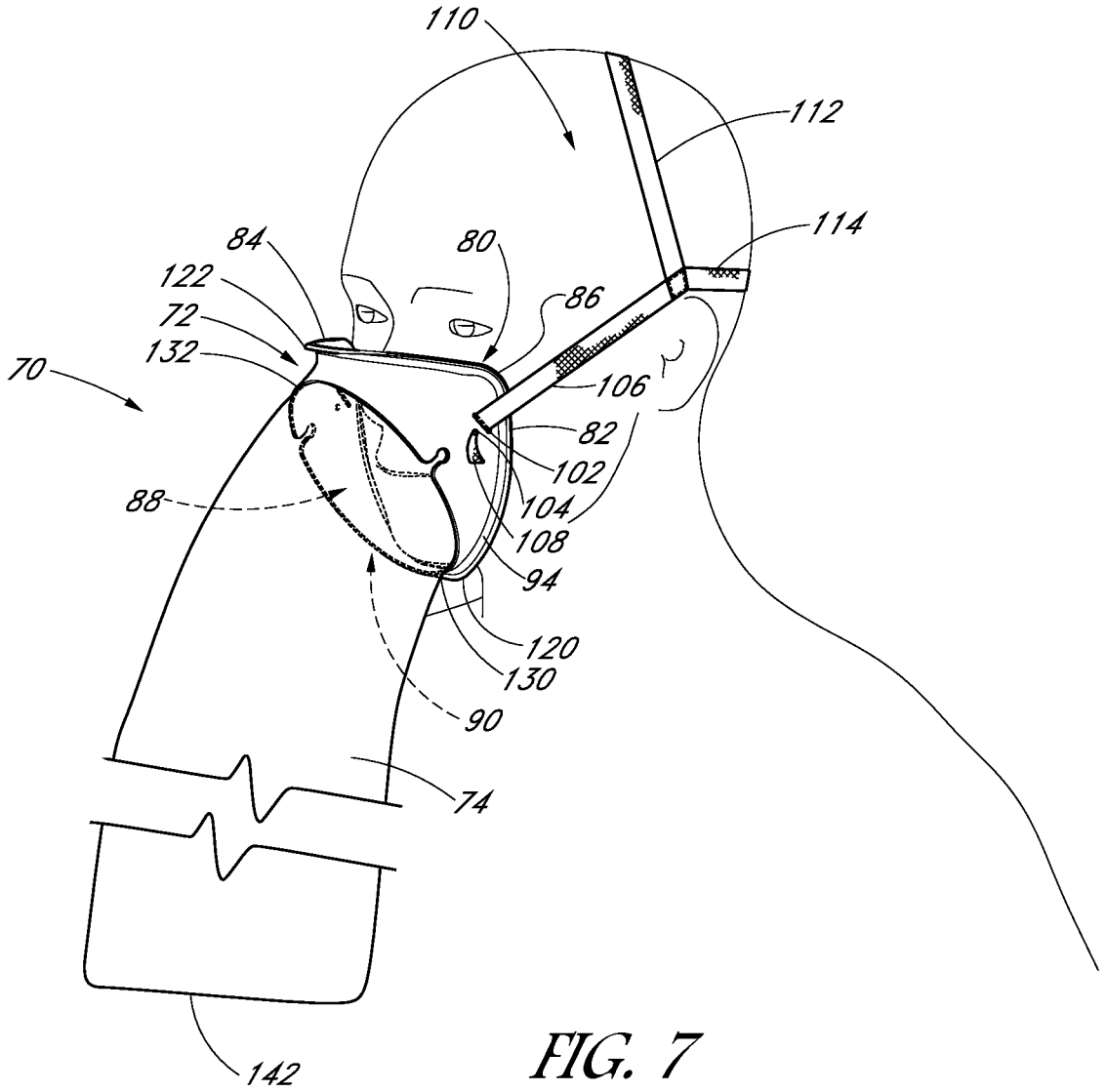
FIG. 7 is a perspective view of the emesis containment system of FIG. 6 installed on a patient/wearer.
Figure 8:
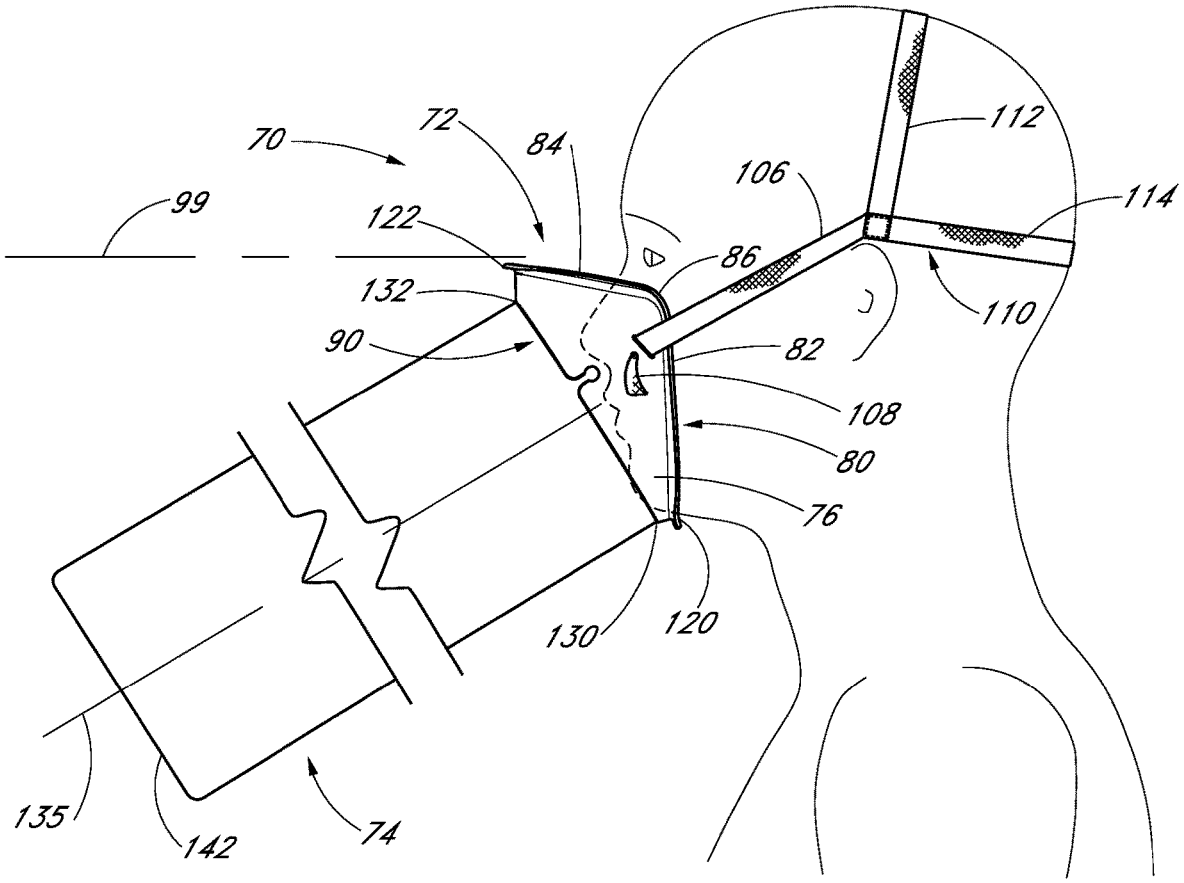
FIG. 8 is a side view of the configuration in FIG. 7.
Figure 9:
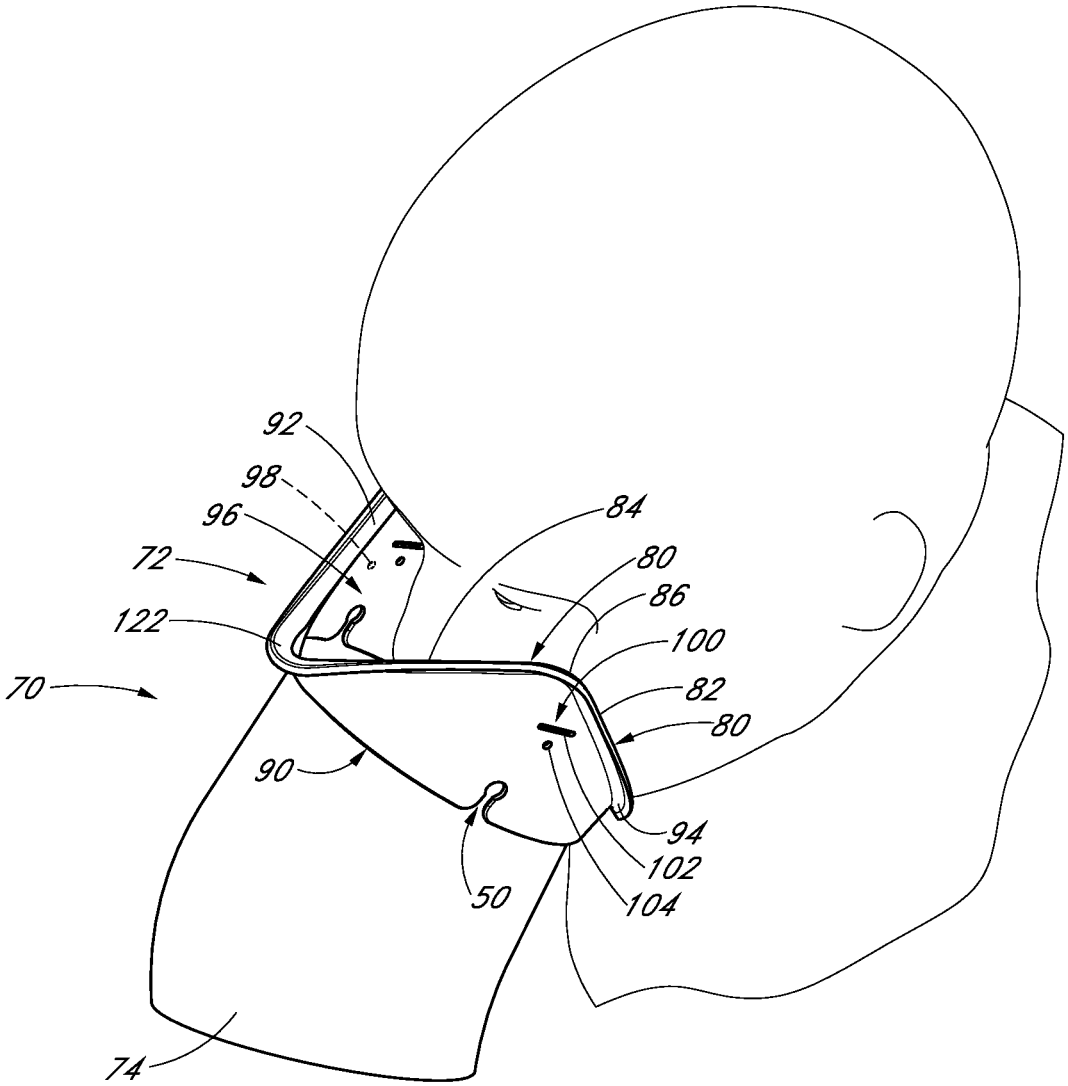
FIG. 9 is a top perspective view of the configuration in FIG. 7.

As shown in FIGS. 7-9, the contact portion 82 of the upstream edge 80 is configured to engage the wearer's face, and in particular the wearer's cheeks behind the mouth and around and under the chin. Most preferably the contact portion 82 is configured so that the entire contact portion 82 is in contiguous contact with the wearer's face, establishing a seal blocking emesis from flowing between the mask 72 and the wearer's face in the contact portion 82. At the transitions 86, the upstream edge 80 diverges from the wearer's face so that the vent portion 84 is spaced from the wearer's face, providing a vent space 96 with substantially uninhibited airflow.

FIG. 8 depicts the emesis containment system 70 being worn by a wearer whose head is positioned in a reference position in which the wearer has a horizontal line of sight 99. Although it is appreciated that the wearer will move their head in many ways and into many disparate positions while wearing the mask 72, in order to describe relative positions and configurations of structures with specificity, such structures will often be described in the context of the wearer wearing the mask while the wearer's head is in the reference position.

With continued reference to FIGS. 4-9, a strap receiver 100 is provided on each of the left and right sides of the mask 72. In the illustrated embodiment, each strap receiver 100 comprises a first strap aperture 102 and a second strap aperture 104. The first strap aperture 102 is an elongated slot configured to receive a strap 106 having a rectangular cross-section, while the second strap aperture 104 is generally round and configured to receive a free end 108 of the strap 106 in a constricted fashion that resists movement of the strap 106 therethrough. As such, to tighten fit, a user can pull on the free end 108 of the strap to advance the strap through the first and second strap apertures 102, 104. As the second strap apertures 104 resist the strap 106 pulling back therethrough, the strap 106 will generally stay in the position to which it is pulled.

In the illustrated embodiment, a securement system 110 for holding the mask 72 on a wearer's face comprises a pair of left and right main straps 106, whose free ends 108 are drawn through corresponding left and right strap receivers 100 of the mask 72. Each main strap 106 terminates in a corresponding joint 110. A top strap 112 and a bottom strap 114 extend between the left and right joints 110, with the top strap 112 configured to extend over the wearer's head and the bottom strap 114 configured to extend about the back of the wearer's head.

In a preferred embodiment, a bottom-most point 120 of the upstream edge 80 engages and is pulled against the underside of the wearer's chin, preferably spaced from a forward-most part of the wearer's chin so that it sits behind edges of the wearer's mouth, such as between about ½-1 inch from the forward-most part of the wearer's chin. The top strap 112 of the securement system 110 preferably supplies pressure to pull the bottom-most point 120 against the underside of the chin. The contact portion 82 of the upstream edge 80 extends upwardly from the bottom-most point 120 to the transitions 86, which preferably are configured to sit above the wearer's mouth, and more preferably to sit above the wearer's nostril openings, and still more preferably to sit higher than a portion of a bridge of the wearer's nose, and below the wearer's eyes.

As best shown in FIGS. 7-9, beginning at the transitions 86, the vent portion 84 diverges outwardly from the wearer's face, defining a vent space 96 between the vent portion 84 of the upstream edge 80 and the wearer's face. The vent space 96 preferably is sized and configured so that breathing air flows in the vent space substantially without restriction or throttling, and sufficient breathing air is available via the vent space 96 so that there is no need to separately supply breathing air to wearers who are not otherwise at risk of breathing distress. In some embodiments, however, a port 98 can be provided in the mask body 76 to which may be attached a source of air, oxygen or the like.

In the illustrated embodiment, an apex 122 of the upstream edge 80 is the highest point of the mask 72 when the wearer is in the reference position. As shown, the apex 122 is higher than and spaced from the tip and—more preferably—much of the bridge of the wearer's nose. Most preferably, the apex 122 is also positioned forwardly of the tip of the wearer's nose. Further, preferably the vent portion 84 of the upstream edge 80 extends upwardly in an uninterrupted fashion from the transitions 86 to the apex 122, so that the apex 122 is higher than the transitions 86 when the wearer is in the reference position. Preferably, however, the apex 122 is lower than the wearer's eyes, or than a line of sight 99 of the wearer.

With continued reference to FIGS. 4-9, the downstream opening 88 preferably is oval. A major axis 126 is defined from a bottom-most point 130 of the downstream edge 90 to an apex 132 of the downstream edge 90, and a minor axis 128 is defined normal to the major axis 126. In the illustrated embodiment, one or more receiver slots 50 are formed through the downstream edge 90. The receiver slots 50 are configured to receive a portion of the flexible bag 74 (preferably after being twisted) so as to hold the flexible bag 74 in a twisted-closed position.

In the illustrated embodiment, the apex 132 of the downstream edge 90 is lower than the apex 122 of the upstream edge 80 when the wearer's head is in the reference position. Similarly, the bottom-most point 130 of the downstream edge 90 is lower than the bottom-most point 120 of the upstream edge 80. Preferably, the body 76 of the mask 72 tapers to reduce its diameter moving from the upstream opening 78 to the downstream opening 88. As such, the mask body 76 generally defines a funnel shape from the upstream edge 80 to the downstream edge 90.

Figure 13:
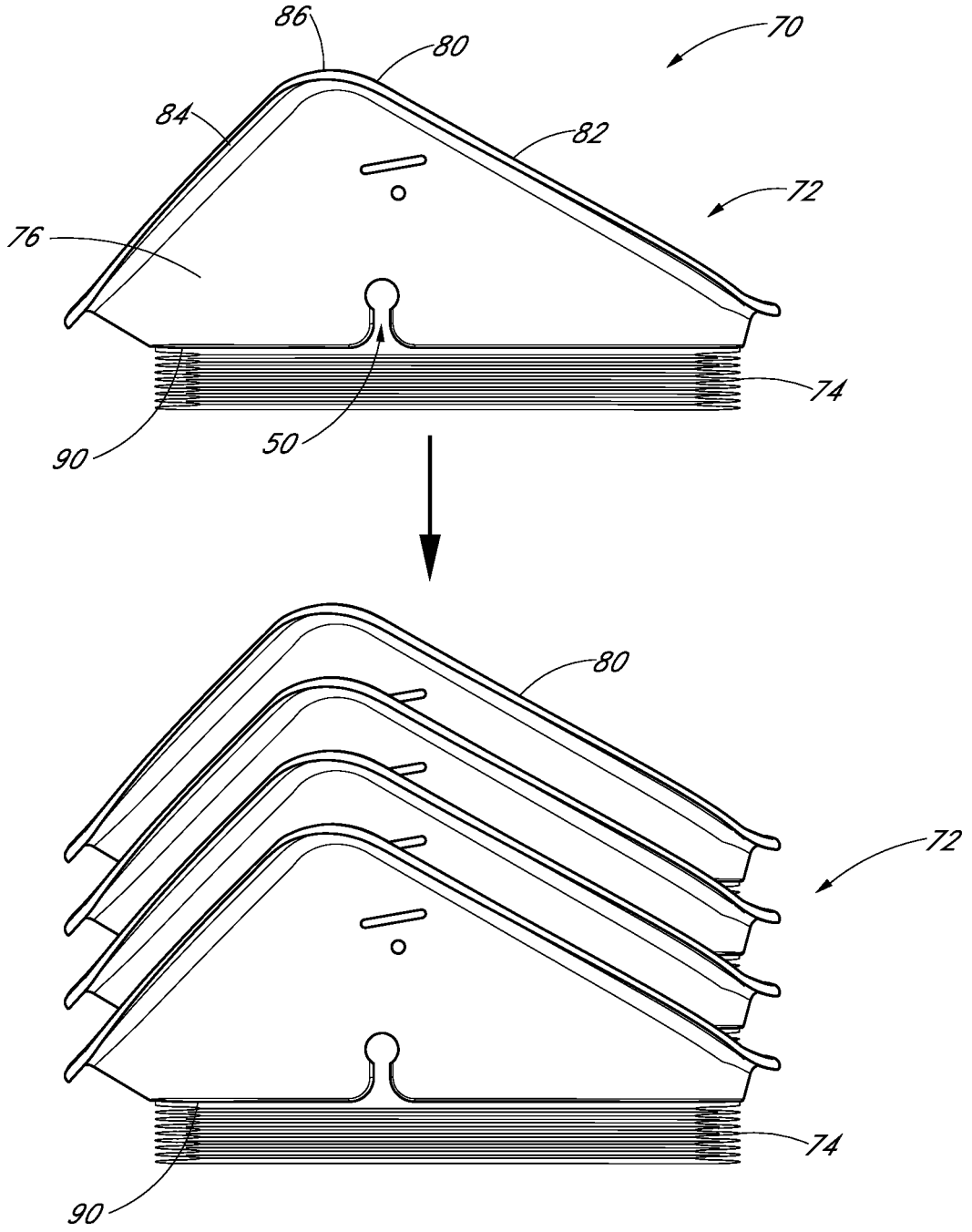
FIG. 13 is a side view of a plurality of the embodiments of FIG. 7 compressed and stacked.

With additional reference to FIG. 13, the mask 72 preferably is configured so that its downstream edge 90 nests within the upstream opening 78 of an adjacent mask 72. The flexible bag 74 preferably is readily folded or crushed so as to also nest with the adjacent mask 72. As such, a plurality of masks 72 can be nested and stacked upon one another so as to facilitate easy storage and access of a plurality of emesis containment systems 70.

In the embodiment illustrated in FIGS. 4-9, preferably no portion of the mask 72 is directly in front of the wearer's mouth or nose. As such, emesis directed out of the wearer's mouth and/or nose most likely will be directed through the downstream opening 88 rather than into contact with the mask 72. The apex 132 of the downstream edge 90 in the illustrated embodiment is higher than the tip of the wearer's nose when the wearer's head is in the reference position. In some embodiments the apex 132 of the downstream edge 90 can be lower than as shown, but preferably the apex 132 is higher than the wearer's mouth, more preferably higher than the outlets of the wearer's nostrils, and even more preferably at a level aligned with a bridge of the wearer's nose. Further, in the illustrated embodiment, the apex 132 of the downstream edge 90 is slightly forwardly of the apex 122 of the upstream edge 80.

In the embodiment illustrated in FIGS. 4-9, when the wearer's head is in the reference position, the downstream edge 90 lies in a plane (unlike the upstream edge 80), and the plane is angled relative to a plane including the bottom-most point 120 and the transitions 86 of the upstream edge 80. As such, an axis 135 of the downstream opening 88 is inclined downwardly relative to a horizontal line of sight 99, as demonstrated in FIG. 8.

In other embodiments the downstream edge 90 may not lie in a plane. In fact, in some embodiments the downstream edge 90 may approximate the curvature of—but be spaced from—the upstream edge 80. Preferably, however, a line from the apex 132 of the downstream edge 90 to the bottom-most point 130 of the downstream edge 90 is inclined relative to a line between the bottom-most point 120 of the upstream edge 80 and one of the transitions 86, so that the axis 135 of the downstream opening 88 is inclined downwardly relative to the horizontal line of sight 99 of the wearer.

The illustrated mask body 76 is elongated somewhat, but is relatively short. For example, in a preferred embodiment the mask body 76 is configured so that a front-most part of the wearer's chin is aligned with or extends forwardly beyond the downstream edge 90. In the illustrated embodiment, the bottom-most point 130 of the downstream edge 90 is configured to be behind the forward-most part of the wearer's chin when the head is in the reference position. In one embodiment, the mask 72 is configured so that when the mask 72 is in place on the wearer's face, the bottom-most point 130 of the downstream edge 90 is about ⅓-¾ the distance between the bottom-most point 120 of the upstream edge 80 and the forward-most part of the wearer's chin.

As discussed above, the mask 72 preferably is rigid or semirigid. Such a mask can be made of any of several materials, including a wide range of medical-grade plastics, rubbers, silicons, metals, and combinations thereof. It is preferred that the mask 72 be sufficiently rigid to maintain its structural shape during use, while possibly allowing some flexing for purposes such as improving fit and comfort.

Figure 6:
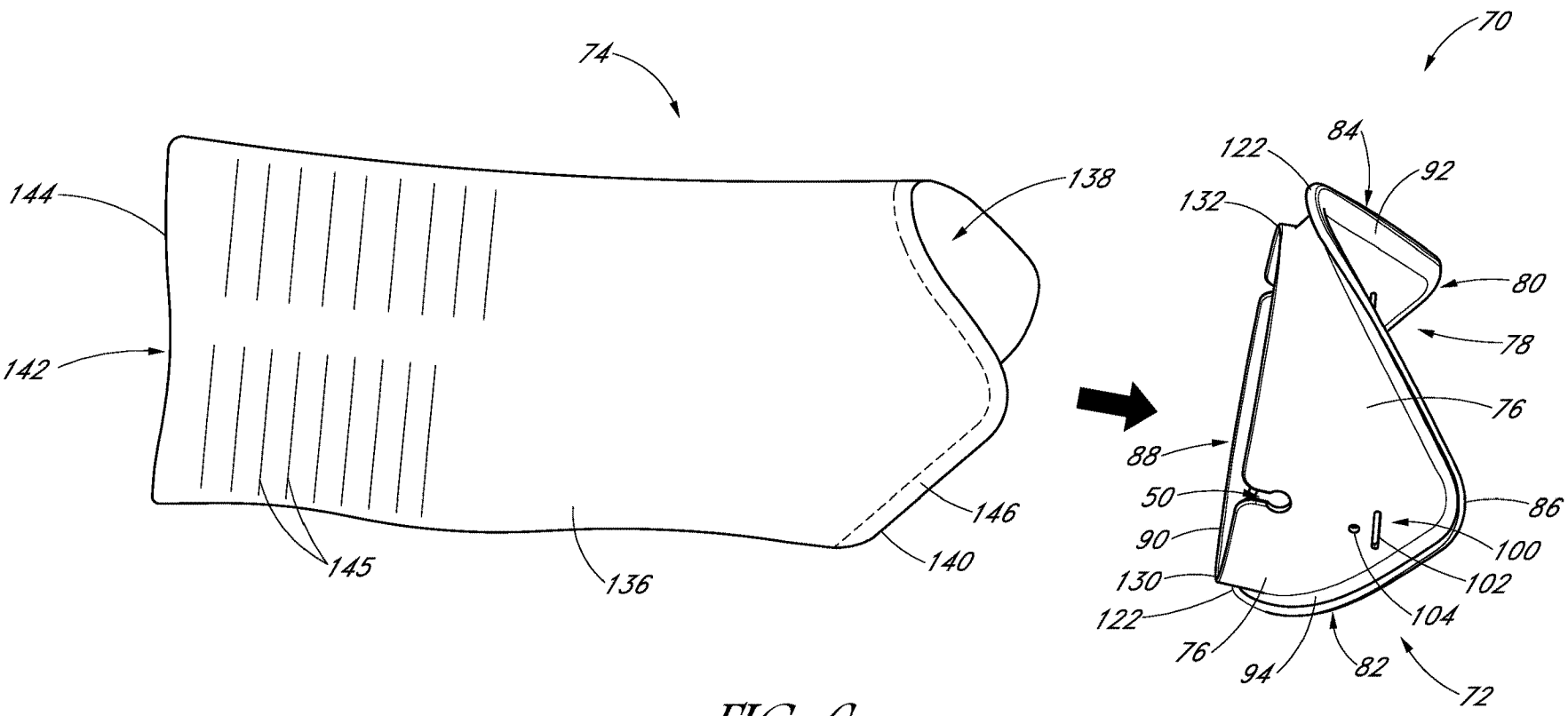
FIG. 6 is an exploded view of one embodiment of an emesis containment system employing a mask as in FIG. 4.

With particular reference to FIG. 6, the flexible bag 74 preferably comprises an elongated tubular body 136 having an open end 138 defined at a top edge 140 and a closed end 142 defined at a bottom seam 144. Indicia 145 may be marked on the bag 74. The top edge 140 of the illustrated bag 74 is shaped complementarily to the upstream edge 80 of the mask 72, and a connection zone 146 is defined adjacent the top edge 140. In a preferred embodiment the flexible bag 74 extends through the mask 72, the top edge 140 is folded over the upstream edge 80, and the connection zone 146 is adhered to the outer flange 94 of the upstream edge 80. As such, the flexible bag 74 not only is aligned with the downstream opening 88, but also lines the interior of the mask 72, and even the portion of the strap 106 lying on the inside of the mask 72 at the securement system 100 is protected from contact with emesis by the flexible bag 74. In the illustrated embodiment, the flexible bag 74 is positioned so that its bottom seam 144 is generally aligned with the major axis of the mask 72 downstream edge 90.

In the illustrated embodiment the flexible bag 74 is formed of a thin plastic. In additional embodiments, other materials such as paper or cloth may be used to construct the bag, and such bags may include a plastic-based layer or other component to prevent wet emesis from leaking through the bag. Preferably embodiments of the flexible bag are water-tight or at least resistant to leaking or breaking down when filled with wet contents.

With the flexible bag 74 attached the mask 72, the entire emesis containment system 70 moves with the wearer without any need of guidance by any party's hands. It operates in a hands-free manner. As such, if the wearer vomits, such emesis is directed into the flexible bag 74, which is maintained generally in front of the wearer's mouth no matter what position the wearer's head may be in, and even if the wearer's head changes position dramatically during the vomiting event. Emesis is directed through the downstream opening 88 and into the flexible bag 74 whether the wearer's head is upright, inclined or turned to either side.

As shown, the mask 72 preferably is hollow and defines a large open space, tapering to the downstream opening 88. The mask 72 is configured and positioned so that most or all emesis likely bypasses the mask 72 and proceeds directly through the downstream opening 88 and into the flexible bag 74. However, the mask's tapered inner structure is configured so that emesis that impinges on the interior of the mask 72 is directed toward the downstream opening 88 and attached flexible bag 74.

Although the flexible bag 74 may be capable of maintaining its shape while empty, preferably the flexible bag 74 is sufficiently flimsy so that once a significant volume of emesis has entered the bag, the flexible bag 74 will readily bend relative to the mask 72 at its interface with the downstream edge 90 of the mask 72 so that the bottom end 142 of the bag 74 is drawn downwardly by gravity regardless of the position of the wearer's head or the mask 72. As such, after emesis is ejected by the wearer, it is highly unlikely that the emesis in the bag will ever be positioned above the wearer's mouth and/or the mask 72 such that emesis would flow from the bag back to the mask 72 and wearer regardless of the position of the wearer's head.

Figure 10:
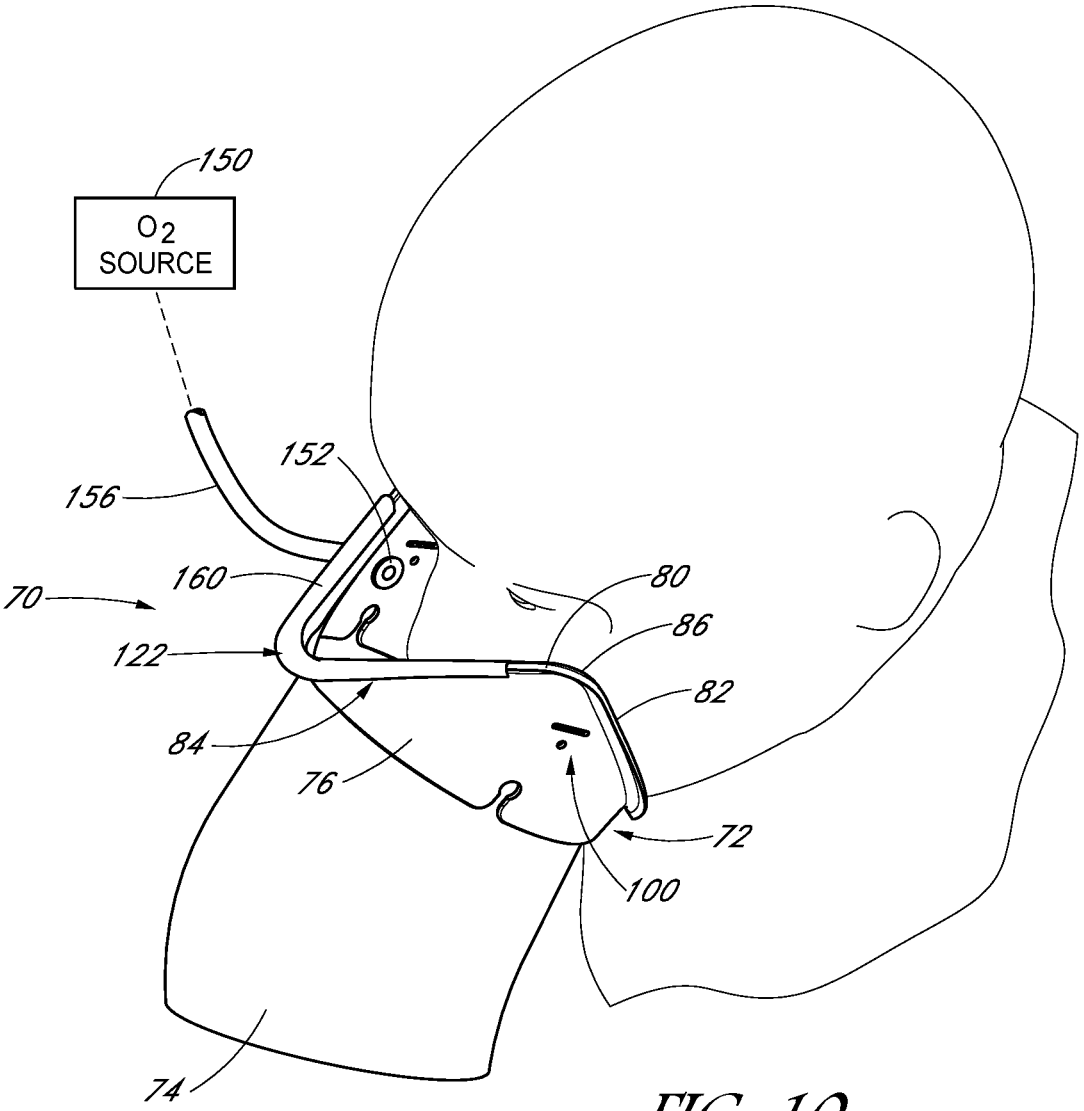
FIG. 10 is a top perspective view of another embodiment of an emesis containment system.
Figure 10A:
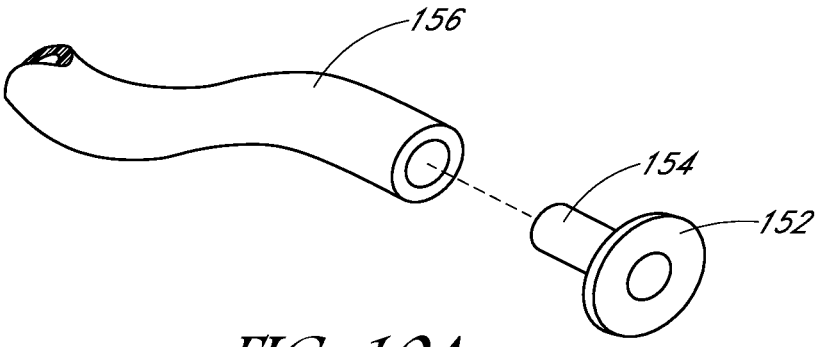
FIG. 10A is a perspective view of a portion of an oxygen provision structure for use in the configuration of FIG. 10.

With reference next to FIGS. 10 and 10A, in another embodiment, a source 150 of oxygen or other breathing gas can be connected to provide oxygen flow through the optional port 98 formed in the mask 72. In the illustrated embodiment, a small one-way valve 152 comprises a post 154 that can be pushed through the port 98 (and the bag lining the mask) and into connection with a tube 156 that is in turn connected to a source 150 of oxygen. As such, blow-by oxygen can be supplied to the space within the mask 72 in order to ensure plenty of breathing gas availability to the wearer. Also, the one-way valve 152 preferably allows oxygen or other breathing gas to be supplied but prevents emesis from entering the supply tube 156.

In the illustrated embodiment, the post 154 can be held in place in a friction fit. In other embodiments a rivet or other fastener on the outside of the mask 72 can engage the post to hold the valve in place. In still other embodiments the valve may be held in place by the post connecting to the tube. Also, while the valve may be provided installed on the mask 72 in some embodiments, in other embodiments the valve may be optionally added to the mask 72 by EMS personnel at their discretion.

FIG. 10 also demonstrates another aspect that can be provided in some embodiments. Specifically, the mask 72 in FIG. 10 preferably is semi-rigid and somewhat flexible so as to enhance compliance with the wearer's face. However, a reinforcement 160 is provided in the vent portion 84 to ensure that the vent portion 84 remains open. More specifically, the reinforcement 160 comprises a rigid member, such as a rigid plastic or metal, clipped or bent over part of the upstream edge 80 in the vent portion 84, and preferably extending across at least the apex 122 of the upstream edge 80. It should be understood that, in other embodiments, other specific structures of reinforcements may be employed and at differing locations along the mask. In some such embodiments a reinforcement can be separately formed and then applied to the mask 72. In other embodiments a reinforcement can be incorporated into the mask 72, such as by being coinjected or by other manufacturing processes.

Figure 12:
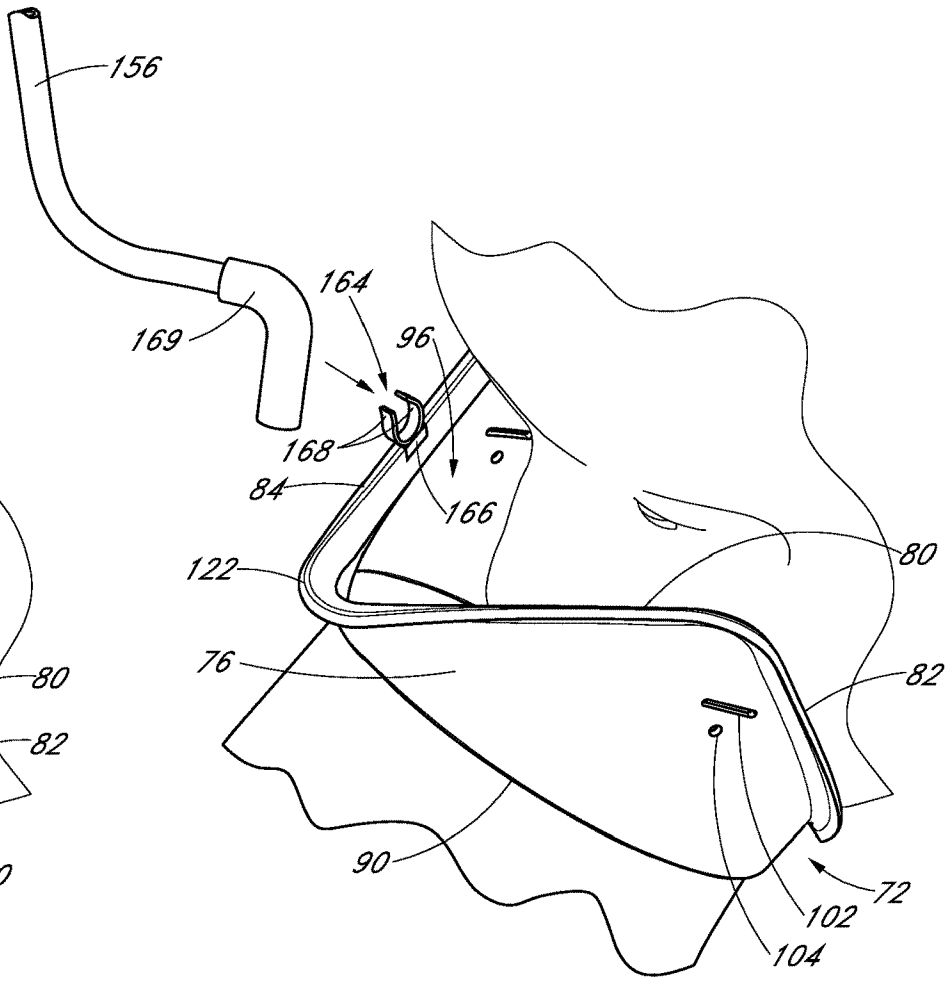
FIG. 12 is a partial perspective view of still another embodiment of an emesis containment system.
Figure 11:
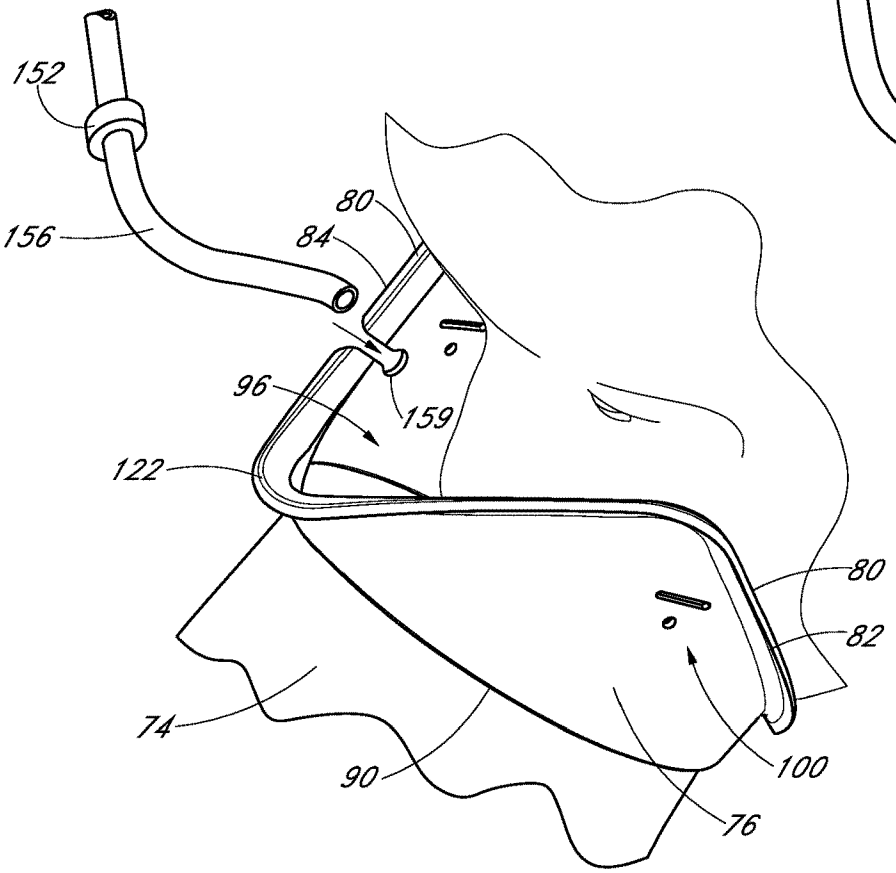
FIG. 11 is a partial perspective view of yet another embodiment of an emesis containment system.

With reference next to FIGS. 11 and 12, additional embodiments are illustrated to show other approaches to providing a blow-by breathing gas. In the embodiment of FIG. 11, a mount slot 158 is formed through the upstream edge 80 in the vent portion 84 and terminates in a tube seat 159 that has a diameter approximating the diameter of an oxygen supply tube 156. The tube 156 can be pushed through the slot 158 to the seat 159. As a width of the slot 158 preferably is less than the diameter of the oxygen supply tube 156, the tube 156 is blocked from moving back through the slot 158. As such, the tube 156 is held in place opening into the space within the mask 72 so that blow-by oxygen can be supplied to such space. Also, in the illustrated embodiment a one-way valve 152 is interposed in the oxygen tube 156 to prevent any emesis from possibly working its way into the oxygen supply.

In the embodiment of FIG. 12, a clip 164 has an anchor portion 166 configured to engage the upstream edge 80 so as to hold the clip 164 in place on the upstream edge 80. The illustrated clip 164 comprises opposing arms 168 configured to accept an oxygen tube 156 therewithin and clasp the tube 156 tightly therebetween. In a preferred embodiment the oxygen supply tube 156 comprises an elbow 169 (here 90°) configured to redirect oxygen supply downwardly through the vent opening 96 and into the space within the mask 72.

It is to be understood that still further embodiments can apply principles as discussed herein in order to selectively provide blow-by breathing gases into the space within the mask 72 at the discretion of EMS personnel so as to ensure availability of sufficient oxygen to maintain proper oxygen saturation.

Figure 15:
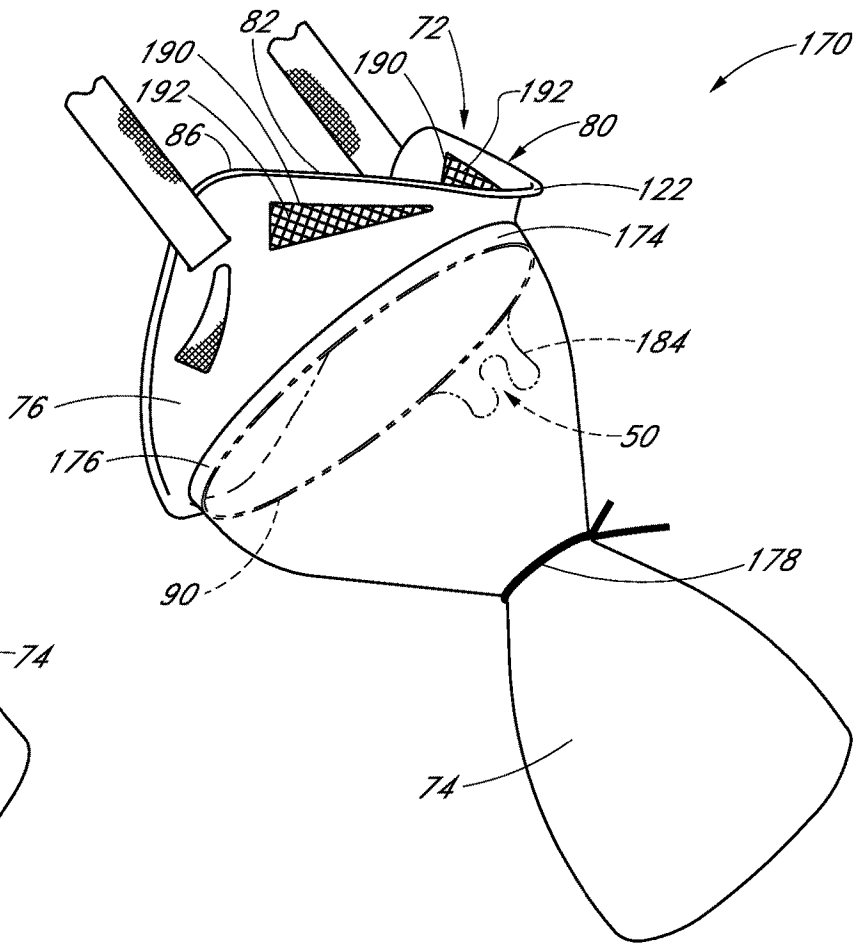
FIG. 15 shows the configuration of FIG. 14 with a bag portion tied off.
Figure 14:
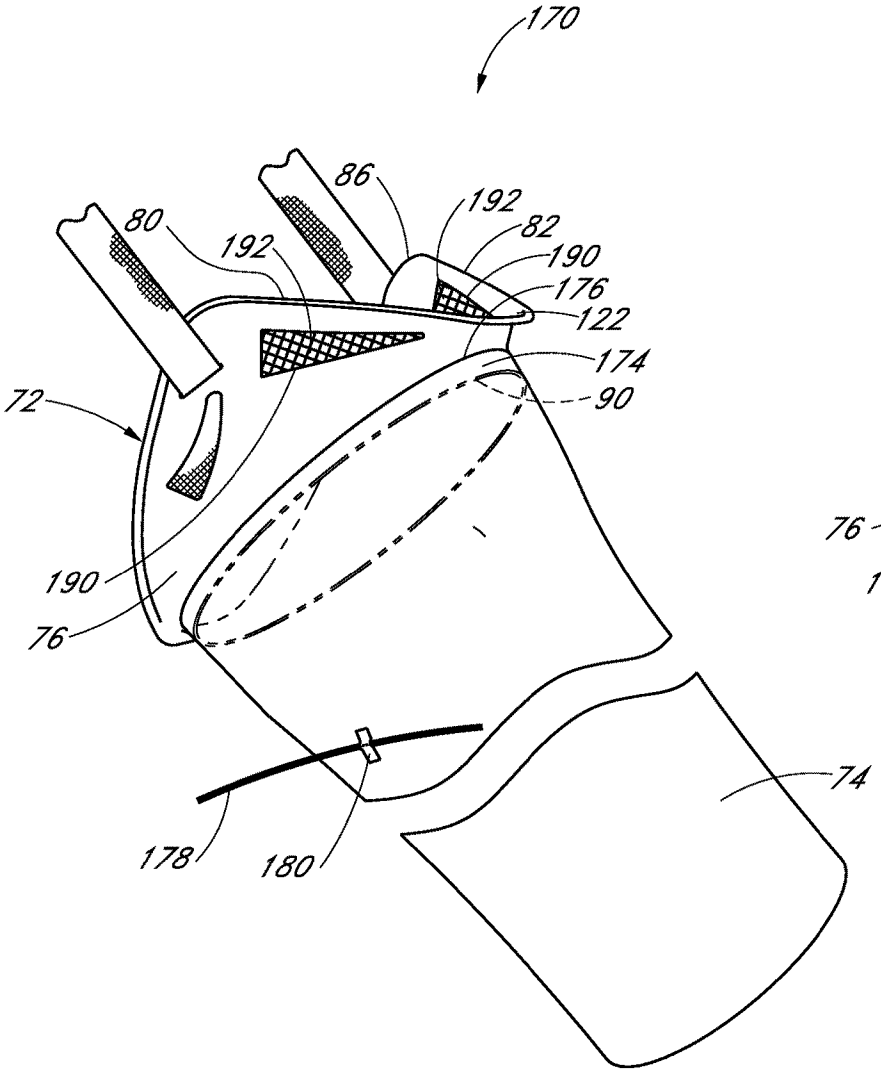
FIG. 14 is a perspective view of another embodiment of an emesis containment system.

With reference next to FIGS. 14 and 15, another embodiment of an emesis containment system 170 is provided. In the illustrated embodiment, the mask 72 includes an attachment seat 174 at and adjacent its downstream edge 90, and about the entire circumference of the downstream edge 90. The top edge 176 of the flexible bag 74 preferably is contoured to fit the attachment seat 174, and the bag 74 is adhered to the mask 72 at the attachment seat 174 so as to attach the bag to the mask 72 in a manner so no emesis can flow between the mask 72 and bag 74. Preferably the attachment seat 174 is on the outside surface of the mask 72 so that the bag 74 is adhered to the outside surface, thus avoiding potential gaps that would tend to collect emesis flowing over the interface between the bag 74 and mask 72.

The illustrated embodiment includes a tie 178 connected to the bag via a releasable attachment structure 180 such as an adhesive tape or mild adhesive. When emesis has been received by the bag 74, the tie 178 can be used to close the bag 74. In additional embodiments the mask 72 can include structure such as the receiver slot 50. Preferably such a receiver slot 50 is included in an optional closure tab 180 (shown in phantom lines) that extends distally from the downstream edge 90 so as to not interfere with the attachment seat 174.

With continued reference to FIGS. 14 and 15, since the bag is connected at and adjacent the downstream edge 90, the bag does not line the inside of the mask 72. As such, the inner surface of the mask 72 directly contacts the wearer's skin. In the illustrated embodiment, left and right vent apertures 190 are formed through the mask 72 near the vent portion 84 of the upstream edge 80. The illustrated vent apertures 190 include a mesh or textile liner 192 configured to allow air to flow therethrough but to block emesis from flowing therethrough. In the illustrated embodiment the vent apertures 190 are positioned in the upper half of the mask 72 so as to be generally above the wearer's mouth and not in a location anticipated to receive a direct flow of emesis. Thus, preferably the lining 192 is selected to maximize air flow therethrough, and rather than being water-tight, the lining 192 may be selected to block minor splashing that may occur from proceeding through the vent apertures 190.

Figure 16:
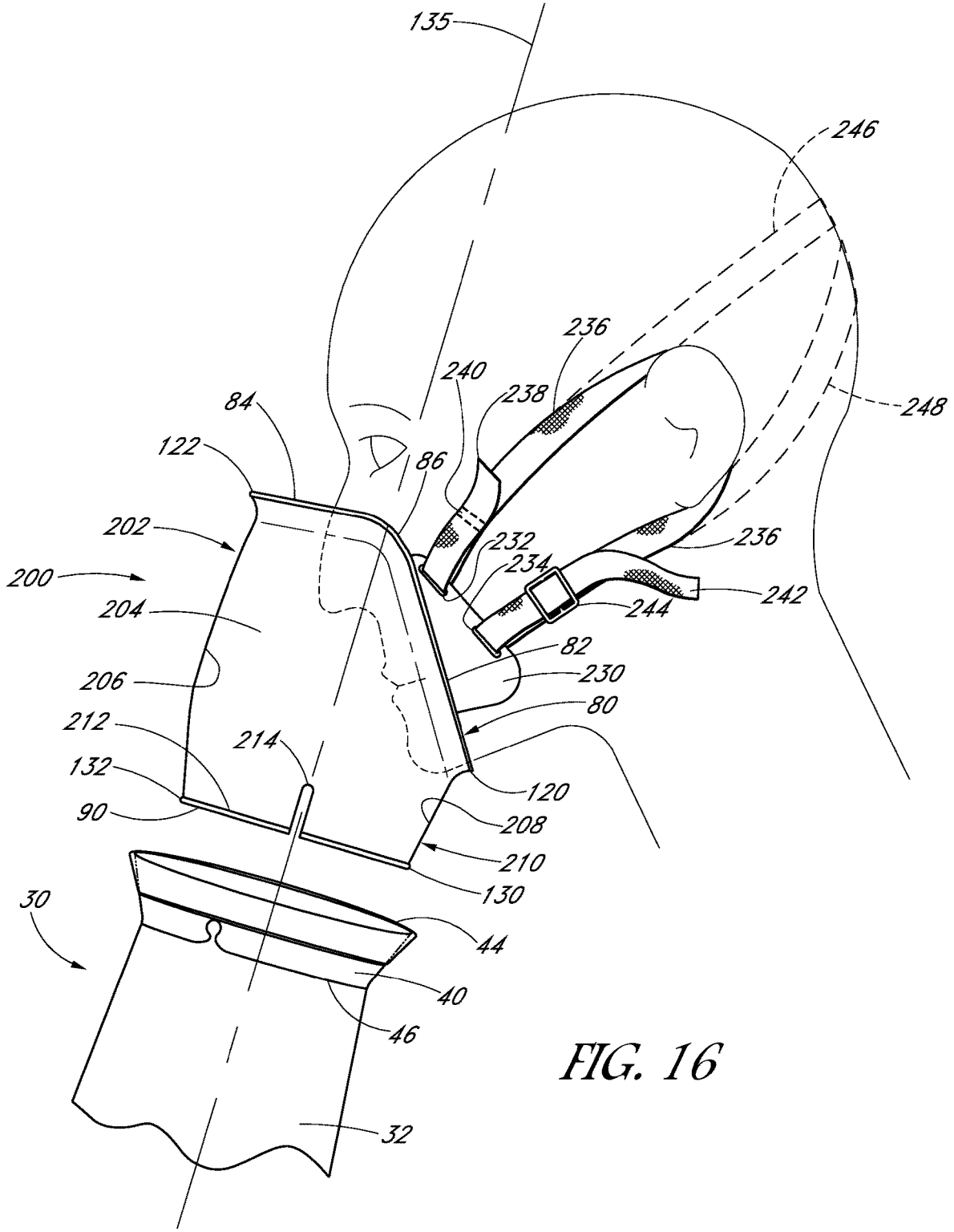
FIG. 16 is a side view of a yet further embodiment of an emesis containment system.
Figure 17:
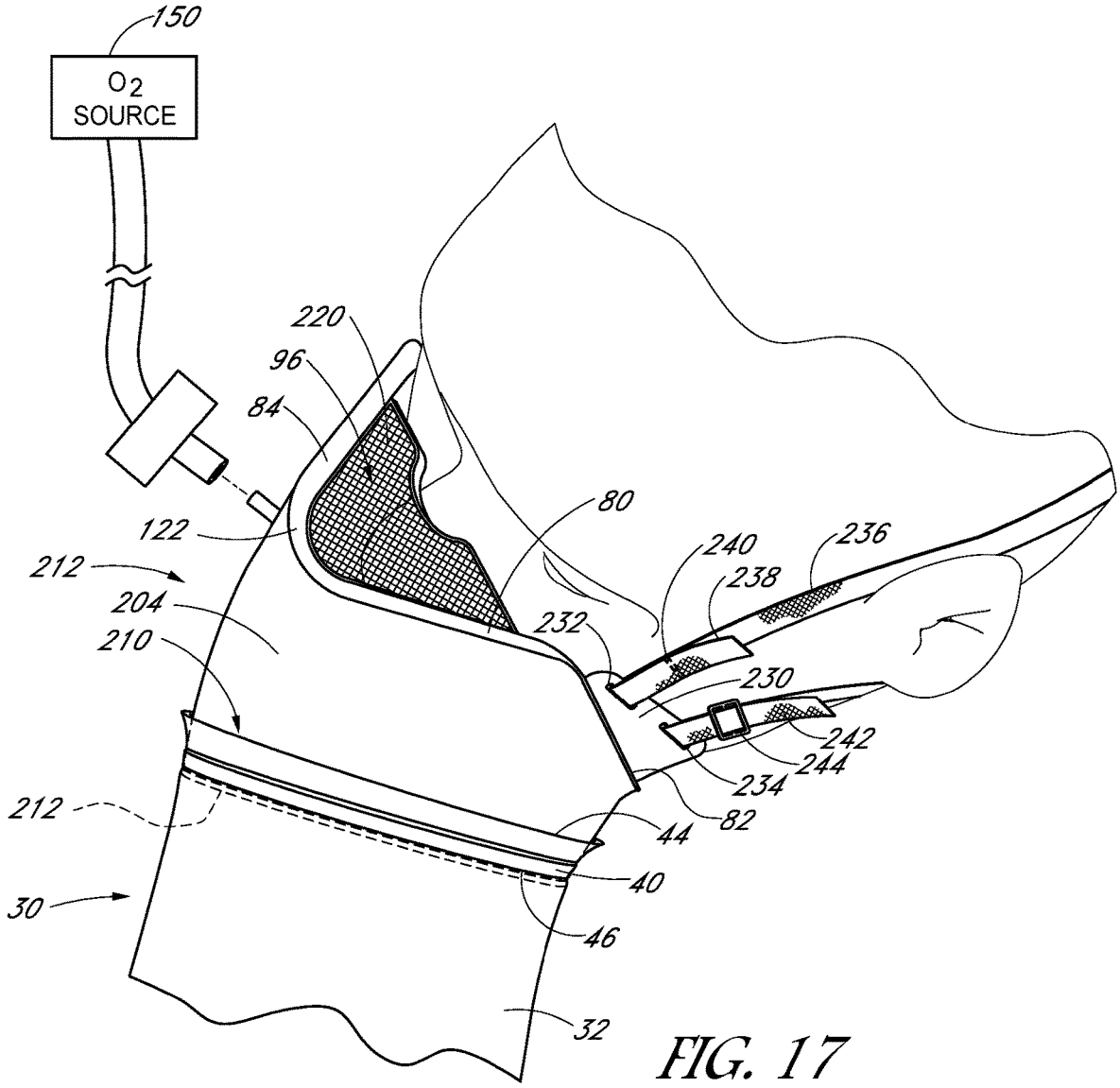
FIG. 17 is a top perspective view of the configuration of FIG. 16.

With reference next to FIGS. 16-17, yet another embodiment of an emesis containment system 200 comprises a mask 202 configured so that that a typical emesis bag 30 can be releaseably connected at and adjacent the downstream edge 90 of the mask 202.

As with previous embodiments, the mask 202 comprises an upstream edge 80 and opening 78 and a downstream edge 90 and opening 88. The mask body 206 in the illustrated embodiment is elongated so that an apex 132 of the downstream edge 90 is at or below a mouth of the wearer. An axis 135 of the downstream opening 88 is inclined downwardly relative to a horizontal line of sight 99 when the wearer's head is in the reference position. Preferably the axis 135 of the downstream opening 88 is inclined downwardly about 45° or more from horizontal when the wearer's head is in the reference position.

A deflection surface 206 of the mask 202 is defined between the apex 122 of the upstream edge 80 and the apex 132 of the downstream edge 90, and is positioned generally parallel to the downwardly-inclined axis 135. The deflection surface is, as shown, at least partially in front of the wearer's mouth so that emesis ejected by the wearer may directly contact and be deflected downwardly by the deflection surface 206 through the downstream opening 88 and into the connected emesis bag 30.

In the illustrated embodiment the bottom-most point 130 of the downstream edge 90 is forwardly of the front-most part of the wearer's chin, and a flow surface 208 defined extending from the bottom-most point 120 of the upstream edge 80 downwardly to the bottom-most point 130 of the downstream edge 90 is also generally parallel to the axis 135. Although the deflection surface 206 and flow surface 208, and in fact the entire inside of the tubular mask 202, are generally parallel to the axis 135 of the downstream opening 88, preferably such surfaces converge slightly so that the inner surface of the mask 202 is slightly funnel-shaped.

As best shown in FIG. 16, a bag attachment zone 210 is defined at and adjacent the downstream edge 90 of the mask 202. In the illustrated embodiment, a radially outwardly-extending lip 212 is defined about the circumference of the downstream edge 90. One or more axially-directed slots 214 are formed through the downstream edge 90 and extend a short distance proximally therefrom. The slots 214 enable the downstream opening 88 to be compressed somewhat upon application of a radially-inwardly-directed force to the downstream edge 90.

As discussed above, a typical emesis bag 30 comprises a rigid or semirigid ring 40 at its proximal end, and the ring is generally funnel-shaped. A diameter of the downstream edge 90 preferably is selected to be less than a diameter of the upstream edge 44 of the emesis bag ring 40 but greater than a diameter of the downstream edge 46 of the emesis bag ring 40. As such, when an emesis bag 30 is advanced proximally over the mask 202 downstream edge 90, the downstream edge 90 will enter through the upstream opening of the ring 40. As the emesis bag 30 is advanced proximally, the downstream edge 90 of the mask 202 will be compressed by the funnel-shaped ring 40. When the downstream edge 46 of the ring 40 moves proximally past the mask's lip 212, the downstream edge 90 of the mask 202 will snap outwardly so that the lip 212 traps the downstream edge 46 of the ring 40 proximal of the lip 212, preventing the emesis bag ring 40 from moving distally and detaching from the mask 202. Preferably, the connection of the emesis bag ring 40 to the mask 202 can be released upon application of sufficient axial force and/or selected compression of the mask 202 downstream edge 90 by the wearer, EMS personnel or a third party.

It is to be understood that other specific structures can be employed to effect a detent-like attachment of the emesis bag to the mask 202. For example, the attachment zone can define a slot for the emesis bag ring, and the ring can be slid transversely into place. In other embodiments, clips or tabs can be employed to selectively keep the emesis bag ring in place. The attachment zone can also define a high-friction area enabling a friction fit of the emesis bag onto the mask 202. Further embodiments can employ an elastic member about a top edge of a flexible bag 74 so that the bag opening is sandwiched between the attachment zone and the elastic member, holding the bag in place on the mask.

With particular reference to FIG. 17, although the vent opening 96 is positioned well out of any anticipated emesis ejection path, the illustrated embodiment comprises a breathable, flexible liner 220 selected to maximize air flow therethrough but to block possible splashes or small droplets of emesis, as well as airborne pathogens associated therewith, from exiting the mask 202 through the vent space 96. In the illustrated embodiment, the liner 220 is flexible so that when the mask 202 is installed on the wearer, the wearer's nose contacts and deflects the liner 220, establishing a tight yet comfortable fit with the bridge of the wearer's nose. In another embodiment, the liner 220 can be formed of a flexible filtration material.

Continuing with reference to FIGS. 16-17, left and right securement tabs 230 extend from the contact portion 82 of the upstream edge 80 on opposite sides of the mask 202. Each securement tab 230 has a top and a bottom strap slot 232, 234 through which a strap 236 can extend. In the illustrated embodiment, the left and right straps 236 each extend about the wearer's ear to hold the mask 202 in place. More specifically, the first free end 238 of each strap 236 overlaps and is attached to the strap 236 via stitching 240 to attach the strap to the top strap slot 232. The second free end 242 is drawn through the bottom strap slot 234 and is attached to the strap 236 via a buckle 244 that allows fit adjustment.

FIG. 16 shows, in phantom lines, yet another embodiment in which a top strap 246 extending through and between the left and right top strap slots 232 is drawn about the back of the wearer's head, and a bottom strap 248 extends through and between the left and right bottom strap slots 234 and about the back of the wearer's head. It is anticipated that various specific types and configurations of securement structures can be used in further embodiments.

Figure 18:
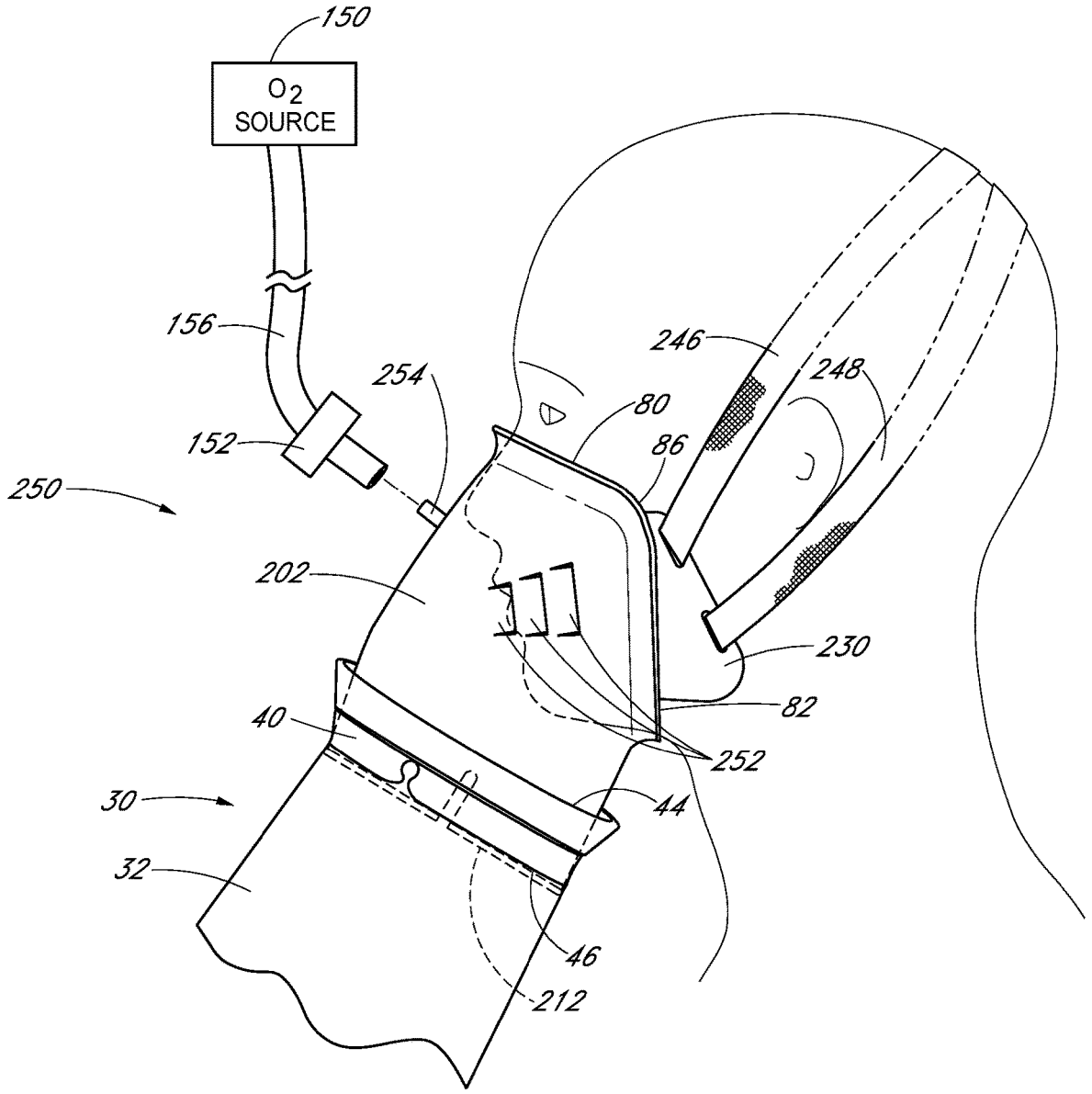
FIG. 18 is a side view of yet a further embodiment of an emesis containment system.

With reference next to FIG. 18, yet another embodiment of an emesis containment system 250 comprises a mask 202 in which the vent portion 84 of the upstream edge 80 is configured to fit much closer to the wearer's fact and/or to contact the wearer's face. As such, the vent space is not sufficient to provide sufficient breathing gas for the wearer.

Preferably, a plurality of vent apertures 252 are formed through the mask 202. In the illustrated embodiment, the vent apertures 252 comprise louvers arranged and configured so emesis flow in a distal direction out of the wearer's mouth will not flow through the louvered apertures 252. Also, preferably a textile liner configured to resist droplet flow therethrough and also block free flow of emesis that may flow proximally into the vent apertures 252. In the illustrated embodiment, the vent apertures are disposed at or above a halfway point of the mask 202, preferably at or above a location of the wearer's mouth when the head is in the reference position. Also, a plurality of sets of louvered vent apertures can be provided in a variety of positions, such as above the bridge of the wearer's nose, generally even with the tip of the wearer's nose, and/or at about the level of the wearer's mouth as shown.

In some embodiments, sufficient venting can be provided via vent apertures 252 so that there is no need for a supplemental oxygen connector. Nevertheless, in the illustrated embodiment, an oxygen connector having structure as a hollow post 254 is provided on the external side of the mask 202 for attachment of an oxygen tube 156 to supply oxygen to the space within the mask 202. The tube 156 may include a one-way valve 152 along its length so as to block emesis from flowing to the oxygen source 150. Such a one-way valve may also be incorporated into the mask 202 in other embodiments.

The embodiments described herein have been discussed in the context of use by EMS personnel. It is to be understood that the principles and structure described herein can be used in other configurations and for other uses. For example, embodiments can be used by police departments, medical offices, transportation organizations, boaters, restaurants, theme parks, and in any instance in which there is a significant risk of vomiting.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. For example, embodiments employing a mask as in FIGS. 4-9 can also include a vent splash guard as shown in connection with the embodiment of FIG. 17. Further, a mask like that in FIGS. 16-17 can be configured so that the flexible bag can be permanently adhered thereto, and masks such as in FIGS. 4-9 and 14-15 can be configured so that an emesis bag can be releasably connected thereto. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. An emesis containment system, comprising:

a rigid or semirigid contoured mask having an upstream opening defined by an upstream edge, a downstream opening defined by a downstream edge, and an elongated body extending from the upstream edge to the downstream edge;

a contact portion of the upstream edge configured to contact a wearer's face when the mask is in place, the contact portion having a bottom-most point of the upstream edge configured to be below the wearer's chin when the wearer's head is in a reference position in which the wearer's line of sight is horizontal;

a vent portion of the upstream edge configured to be spaced from the wearer's face when the mask is in place, the vent portion having an apex of the upstream edge configured to be even with or higher than a tip of the wearer's nose when the wearer is in the reference position;

left and right transitions disposed along the upstream edge between the vent portion and the contact portion;

a securement structure configured to hold the mask in place so that the mask moves with the wearer's head; and a flexible bag attached to the mask and extending therefrom so that the downstream opening of the mask communicates with the bag.

2. The system of claim 1, wherein a bottom-most point of the downstream edge is lower than the bottom-most point of the upstream edge and an apex of the downstream edge is lower than the apex of the upstream edge when the wearer is in the reference position.

3. The system of claim 2, wherein an axis of the downstream opening is inclined downwardly from horizontal when the wearer is in the reference position.

4. The system of claim 3, wherein the body of the mask is inclined downwardly from the bottom-most point of the upstream edge to the bottom-most point of the downstream edge when the wearer is in the reference position.

5. The system of claim 3, wherein the apex of the downstream edge is disposed higher than the wearer's mouth when the wearer is in the reference position.

6. The system of claim 5, wherein the apex of the upstream edge is disposed forwardly of the tip of the wearer's nose when the wearer is in the reference position.

7. The system of claim 5, wherein the apex of the downstream edge is disposed higher than a portion of the bridge of the wearer's nose when the wearer is in the reference position.

8. The system of claim 5, wherein the downstream opening has a major axis extending from the bottom-most portion of the downstream edge to the apex of the downstream edge, and has a minor axis normal to the major axis, and wherein the major axis is greater than the minor axis.

9. The system of claim 1, wherein no portion of the mask is disposed directly in front of a mouth of the wearer when the wearer is in the reference position.

10. The system of claim 1, wherein when the wearer is in the reference position the transitions are vertically even with or higher than a tip of the wearer's nose and the apex of the upstream edge is vertically higher than the transitions.

11. The system of claim 10, additionally comprising an air-permeable textile layer extending proximally from the upstream edge in the vent portion.

12. The system of claim 1, wherein the transitions are adjacent the wearer's cheeks when the wearer is in the reference position.

13. The system of claim 12, wherein the apex of the upstream edge is vertically higher than the transitions when the wearer is in the reference position.

14. The system of claim 1, wherein the flexible bag is releasably attachable to the mask.

15. The system of claim 14, wherein the flexible bag comprises a rigid or semirigid ring at or adjacent an open end of the flexible bag and the mask comprises an attachment structure configured so that the ring can be releasably attached to the attachment structure.

16. The system of claim 1, wherein the mask additionally comprises a connector configured to releasably attach to a source of gas so that a flow of gas can be delivered into a mask space between the wearer's face and the body of the mask.

17. The system of claim 1, wherein the flexible bag is configured so that when a mass of matter is within the flexible bag, the flexible bag will readily bend about the downstream edge of the mask so that the bottom end of the bag is drawn downwardly by gravity regardless of the position of the wearer's head.

* * * * *